US006415751B2

(12) United States Patent
Meissner et al.

(10) Patent No.: US 6,415,751 B2
(45) Date of Patent: Jul. 9, 2002

(54) GAS EXCHANGE VALVE CONTROL FOR INTERNAL COMBUSTION ENGINES WITH AN ELECTROMAGNETIC ACTUATOR, EQUIPPED WITH GAS SPRINGS

(75) Inventors: Frank Meissner; Hans-Joerg Steffens, both of Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/778,795

(22) Filed: Feb. 8, 2001

(30) Foreign Application Priority Data

Feb. 25, 2000 (DE) ..... 100 08 991

(51) Int. Cl.[7] ..... F01L 9/04

(52) U.S. Cl. ..... 123/90.11; 123/90.65; 251/129.16; 335/240

(58) Field of Search ..... 123/90.11, 90.14, 123/90.65; 251/129.01, 129.1, 129.15, 129.16; 335/240, 266, 268

(56) References Cited

U.S. PATENT DOCUMENTS

| | | | | |
|---|---|---|---|---|
| 4,779,582 A | | 10/1988 | Lequense | 123/90.11 |
| 4,883,025 A | * | 11/1989 | Richeson, Jr. | 123/90.11 |
| 5,611,303 A | * | 3/1997 | Izuo | 123/90.11 |
| 5,943,988 A | * | 8/1999 | Burger et al. | 123/90.11 |
| 5,988,124 A | * | 11/1999 | Duesmann | 123/90.11 |
| 6,062,181 A | * | 5/2000 | von Gaisberg et al. | 123/90.11 |
| 6,076,490 A | * | 6/2000 | Esch et al. | 123/90.11 |

FOREIGN PATENT DOCUMENTS

| | | |
|---|---|---|
| DE | 19651846 | 6/1998 |
| DE | 197 25 218 | 12/1998 |
| DE | 198 29 858 | 1/2000 |
| DE | 19838118 | 2/2000 |
| EP | 870906 | 10/1998 |
| GB | 2137420 | 10/1984 |
| JP | 2000034912 | 2/2000 |

* cited by examiner

*Primary Examiner*—Weilun Lo
(74) *Attorney, Agent, or Firm*—Crowell & Moring LLP

(57) ABSTRACT

A gas exchange valve control for internal combustion engines includes an electromagnetic actuator equipped with gas springs. The gas exchange valve control has an armature, which drives the gas exchange valve and is arranged to oscillate between stroke-separated switching magnets against the gas springs. The armature serving as the separating piston between the gas springs is moveable without friction in a closed armature stroke space. A housing-like yoke, which encloses the armature stroke space, including the adjacent switching magnets, exhibits between the switching magnets a device which serves to shorten the respective magnetic circuit of the respective switching magnet.

17 Claims, 1 Drawing Sheet

GAS EXCHANGE VALVE CONTROL FOR INTERNAL COMBUSTION ENGINES WITH AN ELECTROMAGNETIC ACTUATOR, EQUIPPED WITH GAS SPRINGS

BACKGROUND AND SUMMARY OF THE INVENTION

This application claims the priority of German Patent Application No. 100 08 991.7, filed in Germany, Feb. 25, 2000, the disclosure of which is expressly incorporated by reference herein.

The invention relates to a gas exchange valve control for internal combustion engines with an electromagnetic actuator, equipped with gas springs. In this device an armature, which is drive-connected to the gas exchange valve, is arranged so as to oscillate between stroke-separated switching magnets against reset forces of the gas springs. The gas springs, separated by the armature, serving as the separating piston, serve to adjust the adapted spring characteristics by the gas metering valves and gas outlet valves, controlled as a function of the load areas of the internal combustion engine. Furthermore, they serve to damp the stop of the separating piston or the armature on the respective switching magnet.

Such an armature is the object of the German patent application P 100 03 116. Its goal is to achieve variably adapted spring characteristics as a function of the load areas of the internal combustion engine by means of a simple construction. Furthermore, the goal is also to achieve a controlled damping of the stop irrespective of the respective spring characteristic.

In this actuator the outer periphery of the armature, serving as the separating piston between the two gas springs, is equipped with a sliding seal, which is friction-connected to the wall of the armature stroke space. Furthermore, the switching magnets are not designed with respect to optimal magnetic line flux.

The invention is based on the problem of improving this class of actuator both with respect to its mechanical construction and its electromagnetic design so that the cost of energy is reduced and the armature is attracted with increased magnetic force.

This problem is solved according to preferred embodiments of the invention in that the armature is designed without any sliding seal and separates the gas springs. In the respective holding position on a switching magnet the armature defines a damping chamber by means of an intercalated elastomeric element. Furthermore, each switching element exhibits a coil in a core, which is laminated centrosymmetrically relative to a guide shaft of the armature or the gas exchange valve. Each core is designed on the outer periphery flush with a coil, arranged in a peripheral groove bordering the armature-sided face, so as to rest planarly against a yoke, enclosing the switching magnets, including the armature stroke space, and which carries essentially in the center between the switching magnets a mechanism which brings about an increased acceleration force at the armature in the respective holding position.

A goal of the mechanical construction of the design of the invention is to provide in the armature stroke space an armature that separates the gas springs without friction owing to the dispensing of a sliding ring seal and to which is assigned, to achieve an air-damped stop, a damping chamber defined by an elastic element. Since there is no armature friction, the cost of energy is advantageously reduced. Furthermore, the damping chamber of the invention achieves in another advantageous manner that the actuator is acoustically improved.

With the electromagnetic design of the actuator according to the invention, a shorter magnetic circuit for each switching magnet is achieved. Thus, with the reduced magnetic circuit at least in the starting phase of the acceleration of the armature from the holding position on one of the switching magnets, the magnetic resistance in the magnetic circuit is significantly reduced by just an air slit. Thus, independently of the applied gas pressure at the armature, the acceleration of said armature can be increased, a feature that is advantageous in an advantageous manner in particular to achieve high speeds of the internal combustion engine. In connection with the shortened magnetic circuit of each switching magnet, according to the invention, it is especially advantageous that their cores be laminated centrosymmetrically in order to reduce the leakage losses or to reduce the vortex losses, as described and illustrated, for example, in the German Patent Document DE 35 00 530 A1.

With the inventive combination of an improved mechanical construction with an improved electromechanical design of a pneumatic, electromagnetic actuator a gas exchange valve control for internal combustion engines of high efficiency is achieved in an advantageous manner. In this respect it is significantly simpler with the electromagnetic potential of the invention to achieve a load-dependent tuning of the pneumatic system.

Advantageous designs of the invention are described herein and in the claims.

Other objects, advantages and novel features of the present invention will become apparent from the following detailed description of the invention when considered in conjunction with the accompanying drawings.

DETAILED DESCRIPTION OF THE DISCLOSURE

Figure 2:
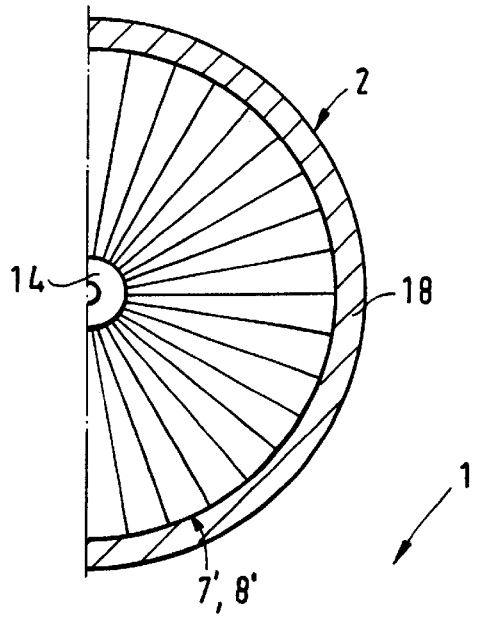
FIG. 2 is a top view of a switching magnet with a centrosymmetrically laminated core taken along the line II—II in FIG. 1.

A gas exchange valve control 1, which is not shown in detail, for internal combustion engines (not illustrated) comprises an actuator 2 with gas springs 3 and 4. An armature 6, which is drive-connected to the gas exchange valve 5, is arranged so as to oscillate between stroke-separated switching magnets 7 and 8 against reset forces of the gas springs 3 and 4. Furthermore, the gas springs 3 and 4, which are separated by the armature 6, formed as the separating piston, serve to determine adapted spring characteristics by means of gas metering valves 9 and 9' and gas outlet valves 10, 10', which are controlled as a function of the load areas of the internal combustion engine. Said gas springs also serve to damp the stop of the separating piston or the armature 6 on the respective switching magnet 7, 8.

To improve the actuator 2, according to the invention, both in its mechanical construction and also in its electromagnetic design, the invention proposes that the armature 6 be designed so as to separate the gas springs 3, 4 without any sliding seal. In the respective holding position on a switching magnet 7, 8 said armature defines a damping chamber 12 by means of an intercalated elastomeric element 11. Furthermore, each switching magnet 7, 8 exhibits a coil 13 in a laminated core 7', 8', which is centrosymmetrical relative to a guide shaft 14 of the armature 6 or the gas exchange valve 5. Each core 7', 8' is designed on the outer periphery flush with a coil 13, arranged in a peripheral groove 16 bordering the armature-sided face 15, so as to rest planarly against a yoke 18, which encloses the switching magnets 7 and 8, including an armature stroke space 17, and which carries essentially in the center between the switching magnets 7, 8 a mechanism 19 which brings about an increased acceleration force at the armature 6 in the respective holding position.

Figure 1:
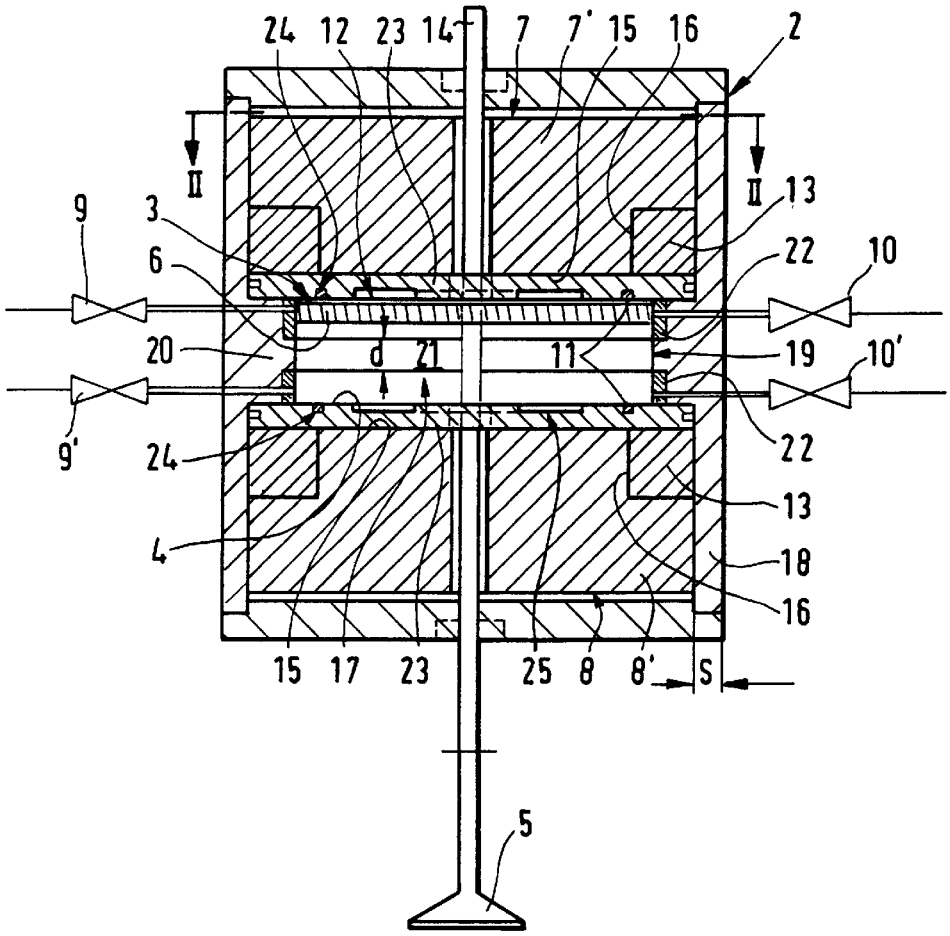
FIG. 1 is a cross sectional view of an actuator assembly for gas exchange control for internal combustion engines, constructed according to a preferred embodiment of the invention.

As evident from FIG. 1, the mechanism 19 is a yoke 18, which is made of a magnetizable material having low hysteresis and which encloses with free passage to the armature 6 an inwardly directed projection 20 on a cylindrical switching magnet 7, 8. The projection 20 with its free inside peripheral area 21 and flush adjoining, non-magnetizable cover rings 22 to both switching magnets 7, 8 defines the armature stroke space 17, enclosing the gas springs 3, 4. The inside peripheral area 21 of the projection 20 serves as an inlet/outlet area of the magnet lines in the vicinity of the armature. With the inventive projection 20 a shortened magnetic circuit is achieved for each of the switching magnets 7 and 8 with magnet lines that run only through an air gap in the vicinity of the armature in the initial phase of armature acceleration.

Furthermore, the wall thickness "s" of the yoke 18, designed as a cylindrical housing, is chosen as a segment of a magnetic circuit in accordance with the magnetic line density in the centrosymmetrically laminated cores 7' and 8'. The projection 20 exhibits a thickness "d", which is equivalent to the yoke wall thickness "s", or the inside peripheral area 21 of the projection 20 exhibits a height equivalent to the wall thickness "s". With this design it is guaranteed that for the magnet lines in the yoke 18 and in the projection 20 the magnetic resistances due to the change in cross section are avoided. To achieve a magnetic circuit with low magnetic resistance the yoke 18 is made preferably of a ferromagnetic material. Furthermore, the cover rings 22, provided on both sides of the projection 20, are made of a non-magnetizable light metal connection, in order to have the magnet lines, issuing from the inside peripheral area 21 or entering into the same, running bundled in the magnetic circuit.

As also apparent from FIG. 1, each switching magnet 7, 8 is assigned on the coil side a face plate 23, which is arranged gas tight in the housing-like yoke 18. Said face plate carries the elastomeric element 11 in an armature-sided groove 24 and forms with a concentric depression 25 a section of the damping chamber 12.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Gas exchange valve control assembly for internal combustion engines with an electromagnetic actuator equipped with gas springs, comprising:

an armature drive-connected to a gas exchange valve, and arranged to oscillate between stroke-separated switching magnets against reset forces of gas springs, and gas springs, being separated by the armature which serves as the separating piston, said gas springs serving to adjust adapted spring characteristics by gas metering valves and gas outlet valves which are controlled as a function of load areas of an internal combustion engine, said gas springs also serving to damp a stop of the armature on a respective switching magnet, wherein the armature is designed so as to separate the gas springs without any sliding seal, wherein, in a respective holding position on a switching magnet, the armature defines a damping chamber by means of an intercalated elastomeric element, wherein each switching magnet exhibits a coil in a laminated core which is centrosymmetrical relative to a guide shaft of the armature of the gas exchange valve, wherein each core is designed on an outer periphery flush with a coil, arranged in a peripheral groove bordering the armature-sided face, so as to rest planarly against a yoke which encloses the switching magnets including an armature stroke space, and wherein said yoke carries essentially in the center between the switching magnets a mechanism which brings about an increased acceleration force at the armature in the respective holding position.

2. Gas exchange valve control assembly as claimed in claim 1, wherein the mechanism is part of the yoke, which is made of a magnetizable material having low hysteresis and which encloses with free passage to the armature an inwardly pointing projection on a cylindrical switching magnet, wherein the projection with its free inside peripheral area and flush adjoining, non-magnetizable cover rings to both switching magnets defines the armature stroke space, enclosing the gas springs, and wherein the inside peripheral area serves as an inlet/outlet area of the magnetic lines in the vicinity of the armature.

3. Gas exchange valve control assembly as claimed in claim 2, wherein the wall thickness of the yoke, designed as a cylindrical housing, is chosen as a segment of a magnetic circuit in accordance with the magnetic line density in the centrosymmetrically laminated cores, and wherein the projection exhibits a thickness, equivalent to the yoke wall thickness.

4. Gas exchange valve control assembly as claimed in claim 2, wherein the yoke is made of a ferromagnetic material, and wherein cover rings, provided on both sides of the projection, are made of a non-magnetizable light metal connection.

5. Gas exchange valve control assembly as claimed in claim 3, wherein the yoke is made of a ferromagnetic material, and wherein cover rings, provided on both sides of the projection, are made of a non-magnetizable light metal connection.

6. Gas exchange valve control assembly as claimed in claim 1, wherein each switching magnet is assigned a face plate on the coil side, which faceplate is arranged gas tight in the housing-like yoke, and wherein the faceplate carries the elastomeric element in an armature-sided groove and forms with a concentric depression a section of the damping chamber.

7. Gas exchange valve control assembly as claimed in claim 2, wherein each switching magnet is assigned a face plate on the coil side, which faceplate is arranged gas tight in the housing-like yoke, and wherein the faceplate carries the elastomeric element in an armature-sided groove and forms with a concentric depression a section of the damping chamber.

8. Gas exchange valve control assembly as claimed in claim 3, wherein each switching magnet is assigned a face plate on the coil side, which faceplate is arranged gas tight in the housing-like yoke, and wherein the faceplate carries the elastomeric element in an armature-sided groove and forms with a concentric depression a section of the damping chamber.

9. Gas exchange valve control assembly as claimed in claim 4, wherein each switching magnet is assigned a face plate on the coil side, which faceplate is arranged gas tight in the housing-like yoke, and wherein the faceplate carries the elastomeric element in an armature-sided groove and forms with a concentric depression a section of the damping chamber.

10. Gas exchange valve control assembly as claimed in claim 5, wherein each switching magnet is assigned a face plate on the coil side, which faceplate is arranged gas tight in the housing-like yoke, and wherein the faceplate carries the elastomeric element in an armature-sided groove and forms with a concentric depression a section of the damping chamber.

11. An electromagnetic actuator for controlling movement of a gas exchange valve of an internal combustion engine, comprising:

an armature connected to move with the gas exchange valve, a yoke surrounding the armature, first and second switching magnets disposed in the yoke and facing one another to form an armature stroke space accommodating the armature, and gas springs in the yoke and operable to adjust spring forces acting on the armature during movement thereof, wherein the switching magnets are operable to move the armature in the stroke space between respective holding positions adjacent respective areas of the switching magnets, elastomeric elements being provided between the armature and a respective switching magnet to form a damping chamber between the armature and respective switching magnet when in a holding position, wherein the armature is configured to separate the gas springs without any sliding seal, and wherein the yoke includes a mechanism disposed between the switching magnets which effects an increased acceleration force at the armature when in or near a respective holding position.

12. An electromagnetic actuator according to claim 11, wherein the first and second switching magnets are centrosymmetrical relative to a guide shaft of the armature.

13. An electromagnetic actuator according to claim 12, wherein each switching magnet exhibits a coil in a laminated core.

14. An electromagnetic actuator according to claim 13, wherein the mechanism is part of the yoke, which is made of a magnetizable material having low hysteresis and which encloses with free passage to the armature an inwardly pointing projection on a cylindrical switching magnet, wherein the projection with its free inside peripheral area and flush adjoining, non-magnetizable cover rings to both switching magnets defines the armature stroke space, enclosing the gas springs, and wherein the inside peripheral area serves as an inlet/outlet area of the magnetic lines in the vicinity of the armature.

15. An electromagnetic actuator according to claim 14, wherein the wall thickness of the yoke, designed as a cylindrical housing, is chosen as a segment of a magnetic circuit in accordance with the magnetic line density in the centrosymmetrically laminated cores, and wherein the projection exhibits a thickness, equivalent to the yoke wall thickness.

16. An electromagnetic actuator according to claim 15, wherein the yoke is made of a ferromagnetic material, and wherein cover rings, provided on both sides of the projection, are made of a non-magnetizable light metal connection.

17. An electromagnetic actuator according to claim 16, wherein each switching magnet is assigned a face plate on the coil side, which faceplate is arranged gas tight in the housing-like yoke, and wherein the faceplate carries the elastomeric element in an armature-sided groove and forms with a concentric depression a section of the damping chamber.

* * * * *

UNITED STATES PATENT AND TRADEMARK OFFICE

CERTIFICATE OF CORRECTION

PATENT NO. : 6,415,751 B2
DATED : July 9, 2002
INVENTOR(S) : Ian Daniel McKenzie It is certified that error appears in the above-identified patent and that said Letters Patent is hereby corrected as shown below:

Column 9,
Line 46, delete “21” and insert -- 14 --.

Signed and Sealed this

Tenth Day of December, 2002

JAMES E. ROGAN
*Director of the United States Patent and Trademark Office*